US006067773A

United States Patent [19]

Le

[11] Patent Number: 6,067,773

[45] Date of Patent: May 30, 2000

[54] SEMI-AUTOMATIC RANDOM BOX SEALER

[75] Inventor: Tuan Vinh Le, York, Canada

[73] Assignee: 3M Innovative Properties Company, St. Paul, Minn.

[21] Appl. No.: 08/892,887

[22] Filed: Jul. 15, 1997

[51] Int. Cl.[7] ..... B31B 1/72

[52] U.S. Cl. ..... 53/387.2; 53/136.4; 53/377.2; 493/117; 493/182; 493/478

[58] Field of Search ..... 53/387.2, 136.4, 53/377.2; 493/475, 478, 479, 182, 117; 198/836.3, 785, 345.1

[56] References Cited

U.S. PATENT DOCUMENTS

| | | | |
|---|---|---|---|
| 1,887,699 | 11/1932 | Reid | 53/387.2 |
| 2,832,463 | 4/1958 | Grebe | 198/821 |
| 3,282,018 | 11/1966 | Bixley | 53/136.4 |
| 3,466,843 | 9/1969 | Mumper | 53/136.4 |
| 3,769,777 | 11/1997 | Miller et al. | 53/387.2 |
| 3,775,937 | 12/1973 | Devan | 53/75 |
| 4,161,138 | 7/1979 | Marchetti | 53/136.4 |
| 4,554,042 | 11/1985 | Marchetti | 156/350 |
| 4,585,504 | 4/1986 | Marchetti | 156/351 |
| 5,099,979 | 3/1992 | Kehrel | 198/345.1 |
| 5,685,814 | 11/1973 | Le | 493/117 |

FOREIGN PATENT DOCUMENTS

| | | | |
|---|---|---|---|
| 219160 | 4/1987 | European Pat. Off. . | |
| 231960 | 8/1987 | European Pat. Off. . | |
| 1438303 | 4/1966 | France | 53/136.4 |
| 1048674 | 11/1966 | United Kingdom | 53/136.4 |
| 2116515 | 9/1983 | United Kingdom . | |

*Primary Examiner*—Peter Vo
*Assistant Examiner*—James P. Calve
*Attorney, Agent, or Firm*—Charles D. Levine

[57] ABSTRACT

A box or carton sealer is disclosed having a frame with a conveyor for moving boxes therethrough. First and second longitudinal, laterally spaced-apart, independent gravity operated centering bars move inwardly and outwardly to center the boxes in the sealer. The centering force produced by the centering bars is proportional to the distance the box is off center in the sealer. A shiftable weight assists the respective centering bars to move laterally as required. A floating head has an inclined entry ramp for riding up over the box and lifting the floating head to a desired height as the box passes thereunder. The floating head has a sealing device for attaching the box flaps at whatever height the flaps happen to be at under the floating head.

15 Claims, 6 Drawing Sheets

SEMI-AUTOMATIC RANDOM BOX SEALER

BACKGROUND OF THE INVENTION

This invention relates to box or case sealers, being apparatus to seal the ends of cardboard boxes or cartons and the like. In particular, the invention relates to semiautomatic case sealers, where the box flaps are already folded closed and it is just desired to seal them shut.

In the packaging industry, many products are packed in cardboard boxes or cartons for shipping. Often, one end of the box, namely the bottom, is sealed shut before the box is filled, and after the box is filled, the top end of the box has to be sealed shut. The top end of the box is usually comprised of end and side flaps that are folded inwardly and downwardly. The box can be sealed by applying glue to the inside or mating surfaces of the folded flaps prior to them being folded, or by applying some other fastening device to the outside of the flaps after they have been folded shut.

In most cases, the boxes are uniform in size, so providing apparatus that will apply some sealing device to the flaps, and perhaps even fold them into a closed position, is not particularly difficult to do. The apparatus can be adjusted to suit the known width and height of the boxes and there is no problem running the boxes through the case sealer once it is adjusted properly.

However, sometimes the boxes are used to pack articles that are not uniform in size, with the result that the boxes are overfilled or underfilled. In some instances, it is also desirable to be able to handle boxes of different sizes coming down the same conveyor line. In these instances, a random case sealer is required, wherein the apparatus for applying the sealing device to the box flaps adjusts automatically to suit the size of the box.

In prior art random case sealers, various sensors have been used to determine the exact size and position of the boxes in the case sealer, and numerous actuators or other adjusting mechanisms, together with programmable logic controls have been used to adjust the position of the various folding and sealing components in response to what is sensed by the sensors. A difficulty with this type of apparatus is that the numerous sensors and actuators are prone to mechanical breakdown and expensive maintenance problems. Further, an overfilled box is not uniform in shape, so the sensors often cannot determine the optimum position adjustments, with the result that the boxes get jammed in the apparatus shutting down the packaging line.

SUMMARY OF THE INVENTION

The present invention is a very simple apparatus for sealing shut previously closed box flaps wherein the sealing components are moved mechanically in response to the exact shape of the box, so the maintenance and jamming problems of the prior art are largely eliminated.

According to the invention, there is provided a box or carton sealer comprising a frame having a longitudinal axis and a conveyor for moving boxes along the axis through the sealer. First and second longitudinal, spaced-apart centering bars are spaced laterally, equi-distant from the longitudinal axis and adapted to move independently inwardly and outwardly to match the width of a box passing therethrough. The bars include diverging entry portions forming a throat to center the box therebetween. First and second independent bias means are connected to the respective first and second centering bars for applying urging forces to the respective centering bars for moving the bars inwardly into engagement with the box. The urging forces are proportional to the distance the box is laterally off center from the longitudinal axis. A floating head is spaced above the centering bars. This floating head includes an upwardly inclined entry ramp adapted to engage and lift the floating head upwardly by the box engaging the inclined entry ramp. The floating head is adapted to mount a flap attaching device centrally thereon. The floating head includes means to hold the box flaps down and space the flap attaching device a predetermined desired height above the box for engagement of the flap attaching device against the box flaps to seal the box shut.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
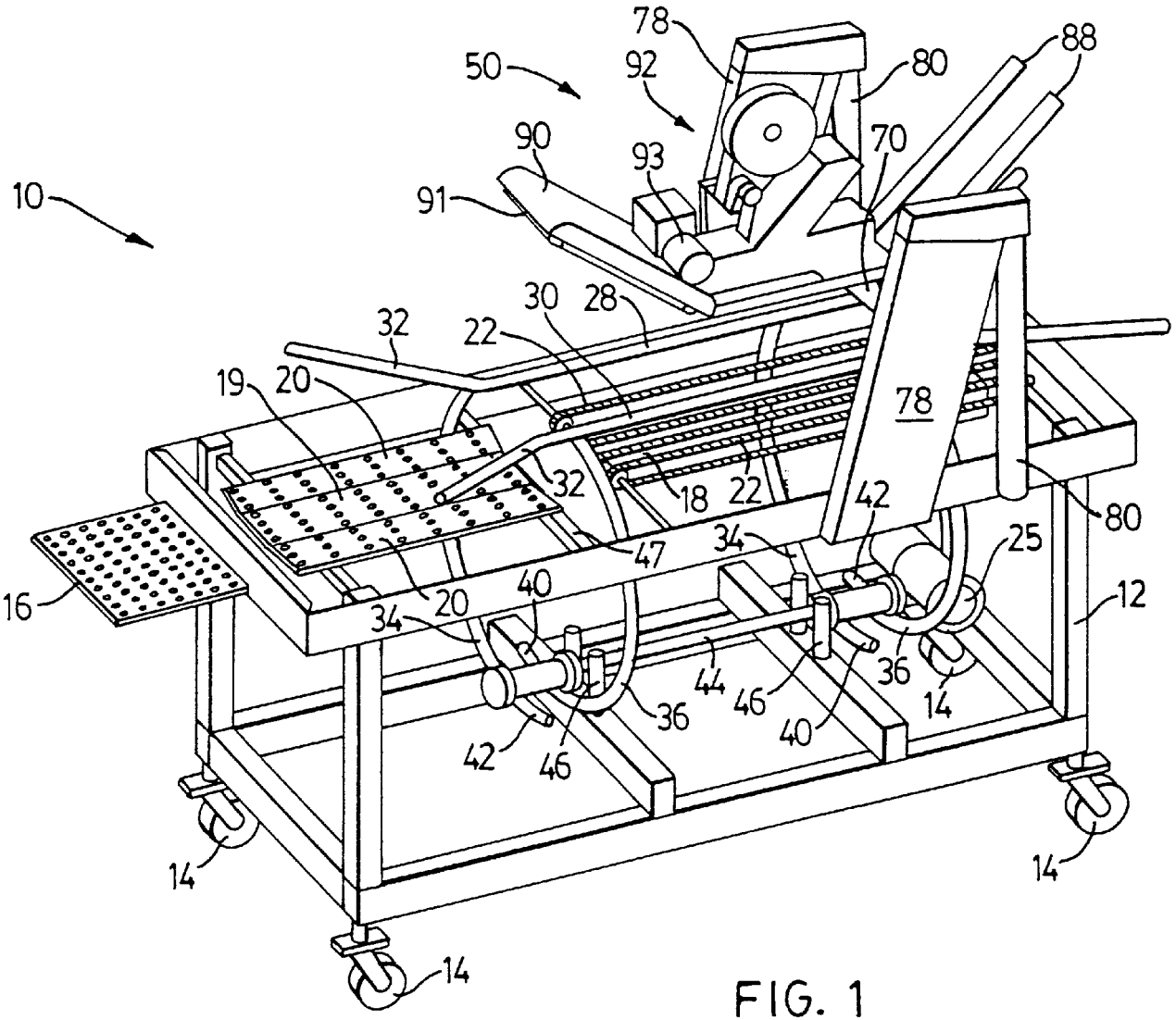
FIG. 1 is a perspective view of a preferred embodiment of a semi-automatic case sealer according to the present invention.

Referring to the drawings, a preferred embodiment of a semi-automatic random case or box sealer according to the present invention is generally indicated in the drawings by reference numeral 10. By semi-automatic, it is meant that the flaps or lids of the boxes or cases are folded to close the box before entering the case sealer. The case sealer just seals the flaps by taping them shut, for example. However, other means could be used to seal the flaps, such as by stapling.

Case sealer 10 includes a frame 12 mounted on casters 14, so that case sealer 10 is easily transportable or moveable from one packaging line to another. A portion of a conveyor packaging line is represented in the drawings by reference numeral 16. Case sealer 10 is located to seal, one at a time, filled boxes received from packaging line 16. The boxes are filled and closed and then manually fed into case sealer 10. The boxes are spaced apart as they are fed through case sealer 10, so that the box ahead is sealed before the next box goes through the sealing process. Packaging line 16 is not considered to be part of the present invention, so it will not be described in further detail herein.

Frame 12 has a longitudinal center axis (not shown) along which is centrally mounted a conveyor 18 for moving boxes along this axis through case sealer 10. Conveyor 18 includes an initial ball-type transfer conveyor portion 19 that allows the boxes to be moved longitudinally and transversely as they are fed into case sealer 10. Preferably, ball conveyor 19 has a flat center section or portion and inclined side portions 20 that are inclined upwardly 1.5 to 2.5 degrees to help center the boxes. Conveyor 18 includes conveyor chains or belts 22. Although four belts 22 are shown, two wider web-type belts could be used if desired. Belts 22 are driven by a suitable motor 25 and connecting chain or belt 26 (see FIG. 2).

First and second longitudinal, spaced-apart centering bars 28, 30 are spaced laterally, equi-distant from the longitudinal axis, to move independently inwardly and outwardly to match the width of a box passing therethrough and center the box in box sealer 10. These centering bars include diverging entry portions or bars 32 that are disposed at an angle from the longitudinal axis of box sealer 10 of about 30 to 35 degrees and are slightly upwardly inclined to urge the boxes downwardly. Diverging bars 32 form a throat to center the box therebetween. If the box is laterally offset, or not centered, it will hit one of the diverging bars 32 first, and the diverging bar that it hits moves it over toward the centerline or longitudinal axis of box sealer 10 where it also engages the other diverging bar 32, and this forces centering bars 28, 30 to move outwardly to accommodate the exact width of the box.

Centering bars 28, 30 are urged inwardly to engage the boxes passing therethrough by means of transverse pivot members 34, 36 attached thereto. Pivot members 34, 36 are pivotally mounted in the frame by hinge members 38 (see FIG. 4). The pivot points 39 of the hinge members 38 are located at points vertically spaced from centering bars 28, 30, so that as the pivot members 34, 36 pivot, centering bars 28, 30 move in and out towards and away from the centerline of case sealer 10. The lower portions of pivot members 34, 36 are cantilevered weighted portions and as such, form first and second independent bias means for applying urging forces to the respective first and second centering bars 28, 30 for moving or urging by gravity the centering bars 28, 30 into engagement with a box located between the bars. As pivot members 34,36 pivot, their centers of gravity shift laterally from pivot points 39. The result is that the centering or urging forces applied by centering bars 28,30 are proportional to the distance the box is laterally off center from the longitudinal axis of case sealer 10.

Figure 4:
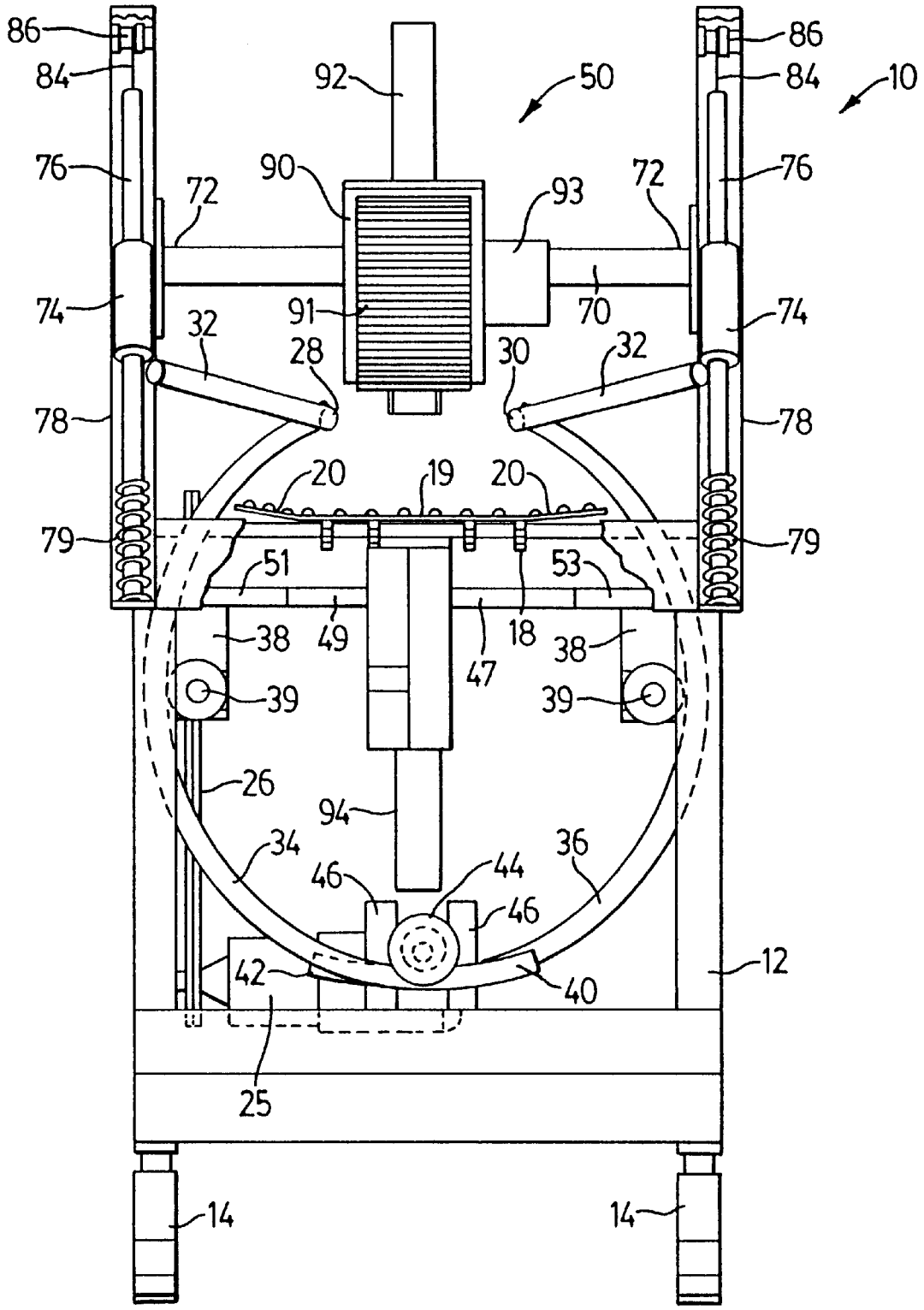
FIG. 4 is an end view of the case sealer taken along lines 4—4 of FIG. 3.

As seen best in FIGS. 1 and 4, pivot members 34, 36 are crescent shaped and extend downwardly and inwardly under centering bars 28, 30 to distal end portions 40, 42 which cross or overlap in the respective pairs of laterally adjacent pivot members. A longitudinal weight 44 is cradled or supported on these overlapping distal end portions 40, 42. Upright posts 46 restrict weight 44 to vertical movement, so that normally, the same cantilevered weight is applied to each centering bar 28, 30. As seen best in FIG. 4, when one of the centering bars 28,30 is urged outwardly, such as by an off-centered box engaging it, weight 44 is lifted by the respective pivot member attached to this engaged bar. This applies an extra centering or urging force to this one engaged centering bar 30 to move the box over to center. The other centering bar and pivot member is then free to move as the box moves over to engage it without any influence by weight 44, until both centering bars are equally laterally offset, in which case, of course, the box is centered in case sealer 10. When the box is centered, both distal end portions 40, 42 engage weight 44, so that the same forces apply to the box by each centering bar 28, 30. The centering forces applied by the bars are thus varied as needed to effectively center the box. Weight 44 is sufficiently heavy such that normally, when an off-center box engages one of the centering or diverging bars 32, it will not move this bar outwardly. Rather, the box will be moved inwardly by this bar until both diverging bars 32 are engaged, in which case centering bars 28, 30 then move outwardly as necessary to center the box passing therethrough.

In the event that very heavy boxes are desired to be sealed in box sealer 10, such that cantilevered weight 44 is not sufficient to ensure that centering bars 28, 30 do cause these boxes to move over to the centerline of case sealer 10, a positive linking mechanism 47 (see in particular FIGS. 3 and 6 to 8) can be used to limit the outward movement of centering bars 28,30. Linking mechanism 47 includes a center housing 49 fixed in position in box sealer 10 and having a pair of sliding arms 51, 53 telescopically located therein. One of the sliding arms 51, 53 is connected respectively to each of the pivot members 34, 36. Each sliding arm 51, 53 has a respective transversely moveable pin 55, 57 located therein that engages a respective cam 59, 61 on the adjacent sliding member. Pins 55, 57 in turn engage respective housing cam portions 63, 65, the latter having respective stops 67, 69 to limit the outward movement of the adjacent arms 51, 53.

Figure 6:
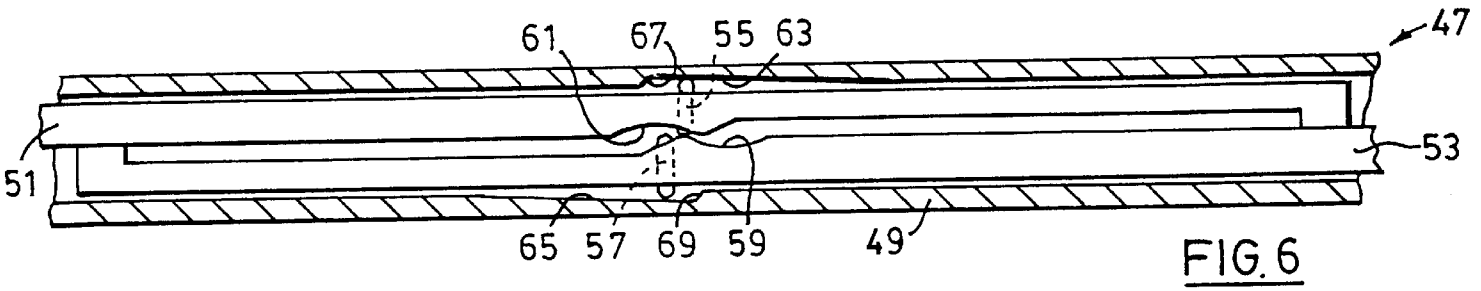
FIGS. 6 to 8 are partial sectional views of a linking mechanism used to help center boxes in the case sealer.
Figure 7:
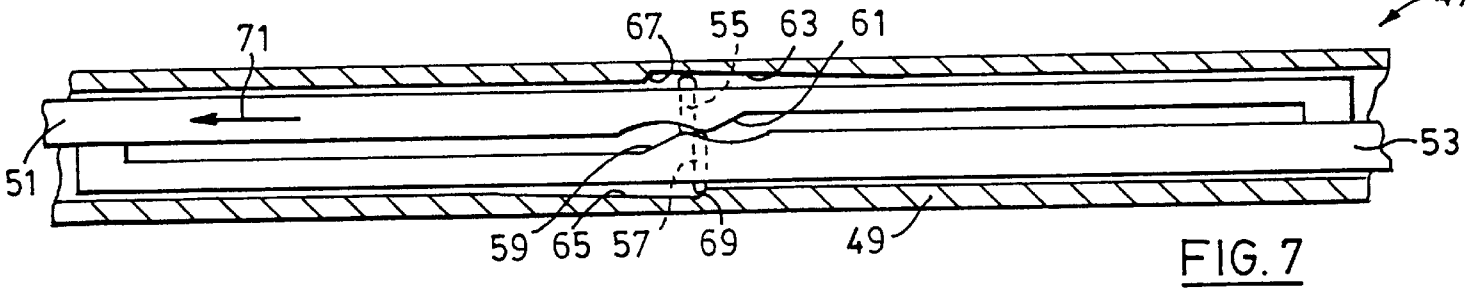
Figure 8:
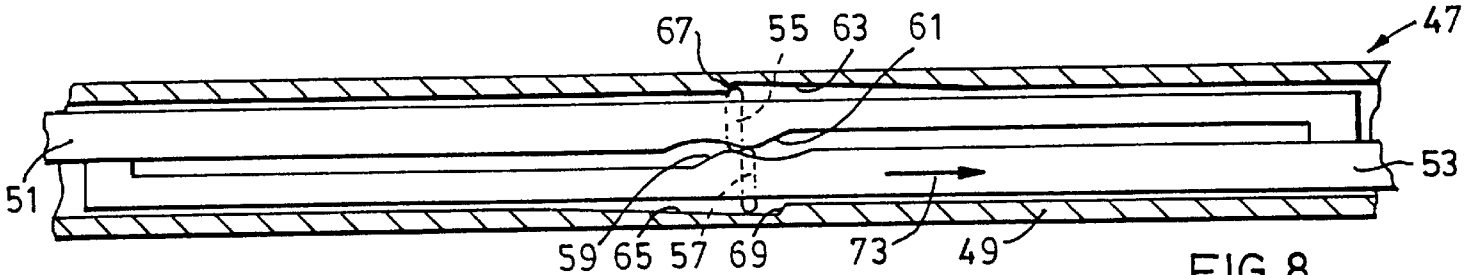

In the operation of linking mechanism 47, FIG. 6 shows the two sliding arms 51, 53 in a position to slide in either direction. In FIG. 7, sliding arm 53 has been pushed to the right (for example, by a heavy, off-centered box hitting centering bar 30). Pin 57 hits stop 69 preventing arm 53 from moving outwardly further, but arm 51 is free to move to the left as indicated by arrow 71. A box hitting centering bar 30 is thus forced to move over toward the center of box sealer 10, and when it hits centering bar 28, arm 51 moves to the left. When the box is centered, cam 61 allows pin 57 to retract allowing both centering bars 28, 30 to move further outwardly in unison to accommodate the actual width of the box. When the box passes through centering bars 28, 30, arms 51, 53 move inwardly again to reset themselves as indicated in FIG. 6. Similarly, in FIG. 8 sliding arm 51 has been pushed to the left (for example, by a heavy, off-centered box hitting centering bar 28). Pin 55 hits stop 67 preventing arm 51 from moving outwardly further, but arm 53 is free to move to the right as indicted by arrow 73. When the box is centered, pin 55 is allowed to retract by cam 59, allowing centering bars 28, 30 to open further as necessary (the box remaining centered). After the box passes through the centering bars 28, 30, the cantilevered pivot members 34, 36 cause arms 51, 53 to reset as in FIG. 6. Of course, if the box is centered properly as it enters centering bars 28, 30, both arms 51, 53 can move outwardly in unison to accommodate the actual width of the box.

Figure 2:
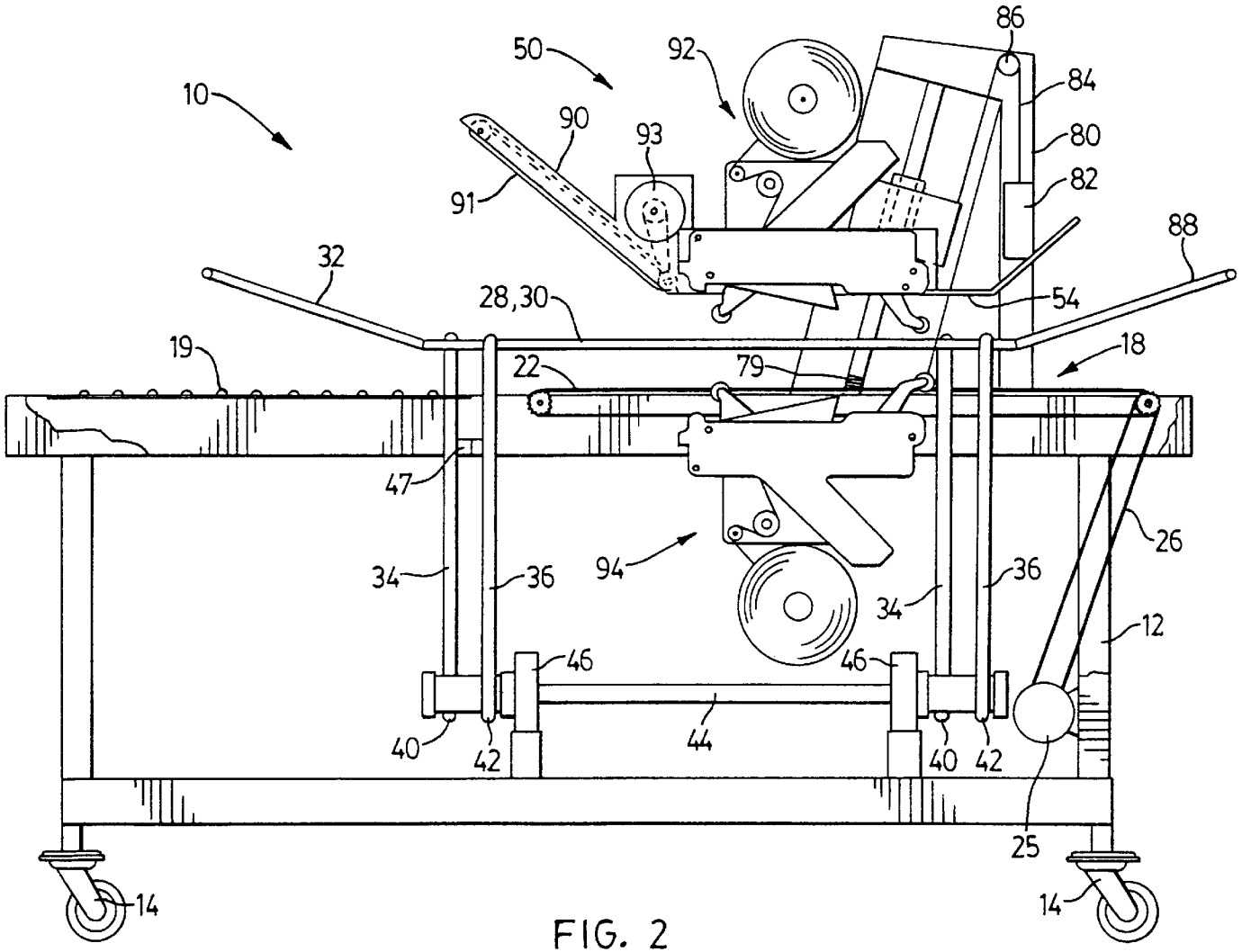
FIG. 2 is a side view of the case sealer of FIG. 1.
Figure 3:
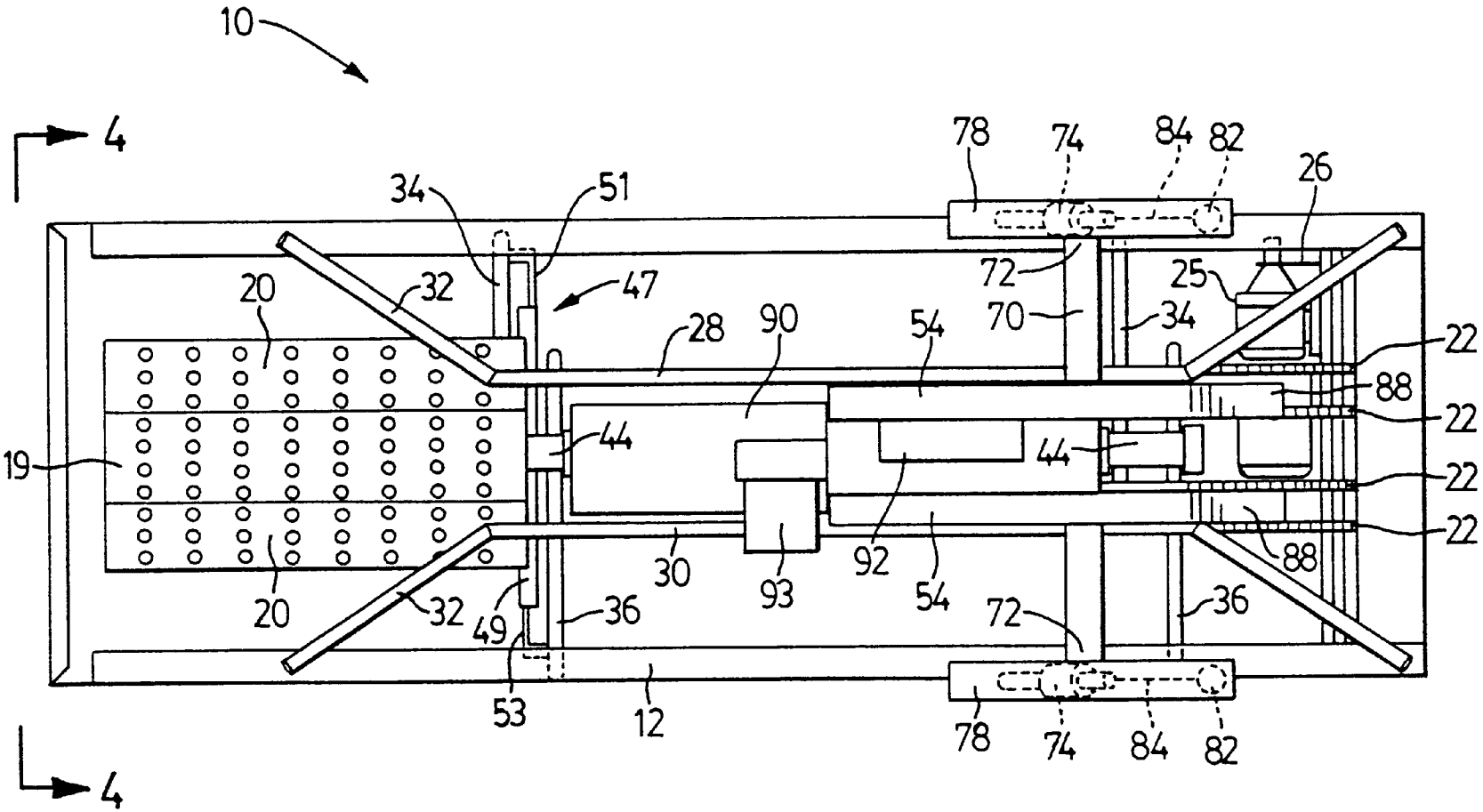
FIG. 3 is a top view of the case sealer of FIG. 1.
Figure 5:
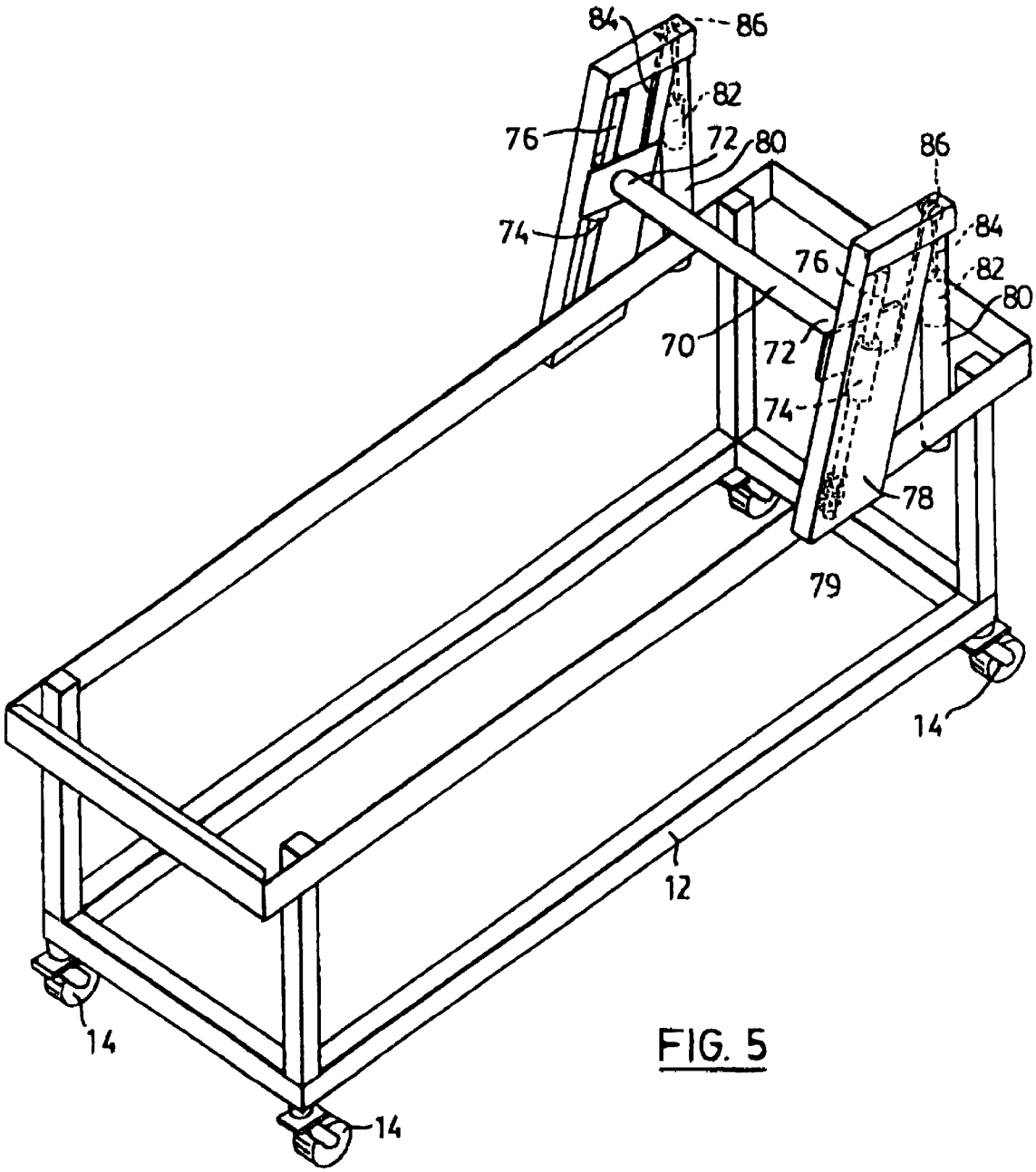
FIG. 5 is a perspective view of a portion of the frame of the case sealer shown in FIG. 1 illustrating the towers to mount the floating head in the case sealer.

Referring next in particular to FIGS. 2, 4 and 5, case sealer 10 includes a floating head 50 spaced above centering bars 28, 30. Floating head 50 includes an upwardly inclined entry ramp 90 inclined at an angle from the horizontal of about 25 to 40 degrees. This entry ramp 90 includes a conveyor belt 91 driven by a motor 93. When the upper leading edge of a box hits entry ramp 90, it urges the box forwardly and downwardly and causes floating head 50 to lift or float upwardly until the floating head sits on top of the box. Floating head 50 is heaviest at the forward end near entry ramp 90 to assist in this action.

Conveyor 18 also helps pull the box through case sealer 10. The box then passes under a main horizontal portion 54 of floating head 50, which keeps the box flaps closed as they are being sealed.

Floating head 50 includes a transverse member 70 (see FIG. 5) having distal ends 72 attached to slides 74 mounted for vertical sliding movement on shafts 76 in inclined towers 78. Slides 74 are preferably in the form of linear bearings mounted on cylindrical shafts 76. Towers 78 are inclined from the vertical in a direction away from the travel of conveyor 18 at an angle between approximately 10 to 20 degrees from the vertical. Towers 78 further include counterweight portions 80 in which are located sliding counterweights 82, the latter being attached by a chain or cables 84 passing over pulleys or sprockets 86 spaced from slides 74 to offset the weight of the portions of floating head 50 that slide along the main part of towers 78. This reduces the amount of force required to be exerted by the box on floating head 50 to cause it to ride up over the top of the box as the latter is being moved through case sealer 10. Towers 78 also include shock absorbers 79 (see FIG. 4) to cushion the downward sliding movement of slides 74. Shock absorbers 79 are in the form of coil springs mounted on shafts 76, and since they are partially compressed when the floating head slides 74 are resting on them, this helps lift the floating head when a box initially contacts entry ramp 52.

Floating head 50 also includes a rear or downstream exit ramp 88 which engages the box as it passes thereunder to lower gently the floating head 50 as the box passes thereby and out of case sealer 10.

Floating head 50 has a flap attaching or sealing device, preferably in the form of a tape dispenser 92 centrally mounted thereon. Any conventional type of tape dispenser can be employed in case sealer 10 and the tape dispenser is not considered to be part of the present invention per se, so will not be described in further detail. Case sealer 10 also has a second optional lower tape dispenser 94 mounted in frame 12 to tape or seal the bottom flaps of the box passing thereover, if these flaps have not already been sealed by the time the box enters case sealer 10. As mentioned above, other sealing devices could be used instead of tape dispensers 92, 94, such as stapling machines, or even heat guns or infra-red heating devices for activating heat-activated adhesives pre-applied to the inside of the flaps of the boxes passing through case sealer 10.

In operation, boxes with their flaps closed are placed on conveyor portion 19 and pushed through centering bars 28, 30, where they are centered in case sealer 10. The box is pushed further to engage entry ramp 90 and conveyor 18. Usually conveyor belt 91 first grabs the box and pulls it into the case sealer and then belt 22 pulls the box the rest of the way through case sealer 10. The box engaging entry ramp 90 causes floating head 50 to float or rise up. It will be appreciated that if the box is overfilled, so that the flaps are not folded all the way down, floating head 50 will still float or rise upwardly to the desired height to allow tape dispenser 92 and optional tape dispenser 94 to tape the flaps shut without jamming.

Having described preferred embodiments, it will be appreciated by those skilled in the art that various modifications may be made to the structures described above. For example, any other type of gravitational biasing of the centering bars 28, 30 could be employed. Other types of counter-balancing mechanisms could be used to offset or counter-balance the weight of floating head 50. Similarly, other types of mechanisms could be employed to allow the floating head to float up and down. Finally, conveyor 18 could be eliminated or replaced by a portion of the existing packaging line 16, if suitable modifications are made to frame 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A box or carton sealer comprising:

a frame having opposite inlet and outlet ends and a generally horizontal axis extending between said ends;

a conveyor mounted on said frame for moving boxes along said axis toward said outlet end;

first and second elongate centering bars;

centering bar mounting means for mounting said centering bars on said frame on opposite sides of said axis for movement in directions transverse to said axis between inner and outer positions to afford engagement of the centering bars on the opposite sides of different width boxes moved along said axis between said centering bars, said centering bars including centering portions generally parallel to said horizontal axis and entry portions diverging from said centering portions toward said inlet end of said frame for helping to center the boxes between said centering bars;

bias means for biasing the centering bars toward said inner positions and into engagement with the opposite sides of various width boxes moved along said longitudinal axis between said centering bars;

a head; and head mounting means for mounting said head on said frame above said centering bars for movement between lower and upper positions relative to said centering bars;

said head being adapted to have a box top flap attaching device mounted thereon and for spacing the box top flap attaching device at a predetermined vertical position with respect to the top surfaces of boxes of various heights moved along the axis at which predetermined vertical position the flap attaching device can attach the top flaps of the boxes in closed positions; and said head including an entry ramp portion at the end of said head adjacent said inlet end of the frame, a conveyor belt moveably mounted on said entry ramp with a portion of said conveyor belt having a bottom surface inclined downwardly from adjacent said inlet end of said frame, and means for driving said conveyor belt so that said portion of the belt moves downwardly and toward said outlet end of said frame so that said portion of the conveyor belt will engage a box moved along said axis between said centering bars and draw the box under the floating head while lifting the head upwardly to said predetermined vertical position.

2. A box or carton sealer according to claim 1 wherein said head mounting means comprises said head including a transverse member having distal ends, two elongate slides, each slide being mounted on said frame adjacent a different one of said distal ends, said slides having opposite upper and lower ends with the lengths of said slides being inclined from the vertical toward said outlet end of the frame, and means mounting each of said distal ends on said adjacent slide for sliding movement to afford movement of said head between said lower and upper positions.

3. A box or carton sealer according to claim 2 further including counterweights and means for connecting said counterweights to said head to partially counterbalance the weight of the head.

4. A box or carton sealer according to claim 2 wherein the slides are inclined from the vertical by an angle in the range of 15 to 20 degrees.

5. A box or carton sealer according to claim 2 wherein said bottom surface of said portion of said conveyor belt is inclined downwardly from adjacent said inlet end of said frame by an angle with respect to horizontal of about 35 degrees.

6. A box or carton sealer according to claim 2 further including springs supported by said frame at the lower ends of said slides and adapted to be compressed by said head when said head is in said lower position.

7. A box or carton sealer according to claim 1 wherein said bottom surface of said portion of said conveyor belt is inclined downwardly from adjacent said inlet end of said frame by an angle with respect to horizontal in the range of 25 to 40 degrees.

8. A box or carton sealer according to claim 1 wherein the head further includes an exit ramp portion at the end of said head opposite said inlet ramp portion, said exit ramp portion having a lowermost surface inclined upwardly toward said outlet end of said frame and adapted to be engaged by a box moving along said axis toward said outlet end of said frame to afford gradual movement of the head toward said lowermost position as the box moves past said exit ramp.

9. A box or carton sealer according to claim 1 wherein said centering bar mounting means include transverse pivoting members attached to the centering bars and pivotally mounted in the frame at points vertically spaced from the centering bars, said pivoting members including cantilevered weighted portions providing said biasing means for biasing the centering bars toward said inner positions and into engagement with the opposite sides of various width boxes moved along said longitudinal axis between said centering bars.

10. A box or carton sealer according to claim wherein said cantilevered weighted portions of said pivoting members on each of said centering bars are arcuate and extend downwardly and under said longitudinal axis with distal parts of said weighted portions of the pivoting members on each of said centering bars extending past the distal parts of said weighted portions of the pivoting members on the other of said centering bars, said weighted portions have arcuate upper surfaces, and said sealer further includes a weight guided by said frame for vertical movement, said upper surfaces of said weighted portions being shaped to support said weight on said upper surfaces of all of said weighted portions when said centering bars are in said inner positions and when said centering bars are displaced the same distance from said inner positions toward said outer positions, and to support said weight only on the upper surfaces of the weighted portions attached to one of said centering bars when that one centering bar is moved farther from said inner position toward said outer position than the other of said centering bars.

11. A box or carton sealer according to claim 9 wherein said cantilevered weighted portions on each centering bar have the same weight and apply the same force to press the centering bars against the sides of a box between the centering bars if the box displaces each centering bar the same distance from said inner positions toward said outer positions.

12. A box or carton sealer according to claim 1 wherein said entry portions of said centering bars are disposed at an angle from said horizontal axis of between 30 and 35 degrees.

13. A box or carton sealer according to claim 12 wherein said entry portions are upwardly inclined from said centering portions toward said inlet end of said frame.

14. A box or carton sealer according to claim 1 wherein said conveyor includes a ball-type transfer conveyor portion adjacent the inlet end of said frame.

15. A box or carton sealer according to claim 14 wherein said transfer conveyor portion includes a generally horizontal center section having opposite sides generally parallel to said axis and side sections along said opposite sides inclined upwardly from said center section.

* * * * *